US011700956B2

(12) United States Patent
Olesen et al.

(10) Patent No.: US 11,700,956 B2
(45) Date of Patent: Jul. 18, 2023

(54) GLASS DOOR WITH A HANDLE ASSEMBLY

(71) Applicant: REHAU-BEHR A/S, Hadsten (DK)

(72) Inventors: Søren Lobdrup Olesen, Hadsten (DK); Jesper Grauballe Rasmussen, Viby (DK); Thomas Lanzl, Regensburg (DE)

(73) Assignee: REHAU-BEHR A/S, Hadsten (DK)

( * ) Notice: Subject to any disclaimer, the term of this patent is extended or adjusted under 35 U.S.C. 154(b) by 0 days.

(21) Appl. No.: 17/798,620

(22) PCT Filed: Feb. 11, 2021

(86) PCT No.: PCT/EP2021/053338
§ 371 (c)(1),
(2) Date: Aug. 10, 2022

(87) PCT Pub. No.: WO2021/160740
PCT Pub. Date: Aug. 19, 2021

(65) Prior Publication Data

US 2023/0092607 A1 Mar. 23, 2023

(30) Foreign Application Priority Data

Feb. 14, 2020 (DK) ..... PA 2020 70087

(51) Int. Cl.
*A47F 3/04* (2006.01)
*E05B 1/00* (2006.01)
(Continued)

(52) U.S. Cl.
CPC ..... *A47F 3/0434* (2013.01); *E05B 1/0015* (2013.01); *F25D 23/028* (2013.01); *A47B 95/02* (2013.01); *F25D 2323/02* (2013.01)

(58) Field of Classification Search
CPC ..... A47F 3/0426; A47F 3/043; A47F 3/0434; F25D 23/02; F25D 23/028;
(Continued)

(56) References Cited

U.S. PATENT DOCUMENTS 4,548,846 A 10/1985 Kurtz
4,745,656 A 5/1988 Revlett
(Continued)

FOREIGN PATENT DOCUMENTS

CA 1245813 A 12/1988
CN 208456282 U 2/2019
(Continued)

OTHER PUBLICATIONS

International Preliminary Report on Patentability, dated Jan. 21, 2022, pp. 1-6, issued in International Application No. PCT/EP2021/053338, European Patent Office, Rijswijk, The Netherlands.
(Continued)

*Primary Examiner* — Andrew M Roersma
(74) *Attorney, Agent, or Firm* — Crowell & Moring LLP; John C. Freeman

(57) ABSTRACT

A glass door for a refrigerating unit and to such refrigerating unit, wherein the glass door includes a glass pane, a handle assembly including a transparent base part bonded at an adhesion surface to an outer glass surface of the glass pane, and a handle part made in a transparent material, preferably Polymethylmethacrylat (PMMA). The handle assembly further includes a mounting connection for mounting the handle part to the base part, wherein the mounting connection is provided by the one or more protrusions of the handle part and by one or more recess(es) in the base part or one or more recess(es) provided between the base part and the outer glass surface.

12 Claims, 4 Drawing Sheets

(51) Int. Cl.
*F25D 23/02* (2006.01)
*A47B 95/02* (2006.01)

(58) Field of Classification Search
CPC .. F25D 2323/02; E05B 1/0015; E05B 1/0061; E05B 1/04; Y10T 16/458; Y10T 16/459; Y10T 16/462; Y10T 16/469; Y10T 16/498; Y10T 16/513; A47B 95/02
See application file for complete search history.

(56) References Cited

U.S. PATENT DOCUMENTS

| | | | | |
|---|---|---|---|---|
| 6,463,628 | B1 * | 10/2002 | Yeh | E05B 1/0015 292/DIG. 53 |
| 6,954,967 | B2 * | 10/2005 | Park | E05B 1/0015 428/68 |
| 8,607,506 | B2 * | 12/2013 | Bouthillier | E05B 1/0015 49/460 |
| 2002/0078530 | A1 * | 6/2002 | Tasman | E05B 1/0015 16/412 |
| 2003/0079313 | A1 | 5/2003 | Pohl et al. | |
| 2012/0005822 | A1 * | 1/2012 | Daubmann | A47K 10/10 4/607 |
| 2013/0125345 | A1 * | 5/2013 | Specht | E05B 1/0015 16/412 |
| 2021/0156606 | A1 * | 5/2021 | Kim | E05B 1/0038 |

FOREIGN PATENT DOCUMENTS

| | | | | |
|---|---|---|---|---|
| DE | 10 63 925 | B | 8/1959 | |
| DE | 3806254 | A1 | 8/1989 | |
| DE | 19624601 | C1 | 6/1997 | |
| EP | 2503079 | A1 | 9/2012 | |
| FR | 1476347 | A | 4/1967 | |
| IT | MI20120558 | A1 | 10/2013 | |
| WO | WO 97/48319 | A1 | 12/1997 | |
| WO | WO-9748319 | A1 * | 12/1997 | A47B 95/02 |

OTHER PUBLICATIONS

International Search Report and Written Opinion, dated May 20, 2021, pp. 1-10, issued in International Application No. PCT/EP2021/053338, European Patent Office, Rijswijk, The Netherlands.

* cited by examiner

GLASS DOOR WITH A HANDLE ASSEMBLY

This application is a national application based on Patent Cooperation Treaty Patent Application No. PCT/EP2021/053338, filed on Feb. 11, 2021, the entire contents of which are incorporated herein by reference.

This application claims under 35 U.S.C. § 119(a) the benefit of the filing date of Danish Patent Application No. PA202070087, filed on Feb. 14, 2020, the entire contents of which is incorporated herein by reference.

BACKGROUND OF THE INVENTION

Field of the Invention

The invention relates to a glass door with a handle assembly for a door or a lid of a refrigerating unit.

Description of Related Art

Handles for glass doors are generally known to be either attached by means of screws arranged through borehole of the glass pane, or via a frame arranged around the glass pane. Other means for providing a handle may include applying a recess or openings through the glass pane itself, which are large enough to accommodate a sliding or swinging movement made by the user.

Providing handle mounted in through-hole or in recesses in the glass pane has the disadvantages of reducing the integrity of the glass pane in the position of the handle, which in turn reduces the amount of loads that can be applied to the handle when in use. Both during installation and during use, a crack may form originating from the through-hole, or the glass may shatter.

It is therefore an object of the present invention to provide a handle, which is easy to install and further can be mounted without compromising the integrity of the glass pane. It is a further object of the present invention to provide a handle that is aesthetically pleasing to the eye. Moreover, it is an object of the present invention, to provide a handle, which upon impact provides a degree protection for the glass pane and which is easy to replace if damaged.

SUMMARY OF THE INVENTION

The first aspect of the present invention relates to a glass door for a refrigerating unit including:

a glass pane, a handle assembly including a transparent base part bonded at an adhesion surface to an outer glass surface of the glass pane, and a handle part made in a transparent material, preferably Polymethylmethacrylat (PMMA), wherein the handle assembly further includes a mounting connection for mounting the handle part to said base part, wherein the mounting connection is provided by the one or more protrusions of the handle part and by one or more recess(es) in the base part or one or more recess(es) provided between the base part and the outer glass surface.

Advantageously, by the present invention a handle assembly is provided including transparent elements, such that it is of an aesthetic appearance reassembling the glass pane, whereby the glass pane with the handle assembly is more pleasing to the eye. In one or more embodiments, the base part and/or handle part may preferably be of the same color as the glass pane. In one or more embodiments, the handle part and/or the base part may be of a different color than the glass pane. In a further embodiment, the handle part and/or the base part and/or the glass pane may be semi-transparent with a shade of the same colors or of different colors.

For the present disclosure, the term "bonded" refers to a bonding of two surfaces by a chemical process or by an adhesive. By the present invention the handle assembly may advantageously be fastened to said glass surface by bonding at the adhesion surface, thereby avoiding drill holes to be provided through the glass surfaces, which could otherwise compromise the strength of the glass pane. In one or more embodiments, the bonding may be provided by evaporation of a solvent or by curing with heat, pressure, or time.

In one or more embodiments, the bond is preferably of a bonding strength larger than the strength of the mounting connection, such that in the event that the handle is impacted by a large force, e.g. from a trolley, the mounting connection will be more likely to disconnect than the bonded connection between the base part and glass pane. The base part is preferably configured to remain on the glass surface, while the handle breaks or is forced to disconnect from the base part. The handle part may thereafter be re-connected to the base part or be replaced.

In one or more embodiments, the handle assembly is configured to provide a detachment of the handle part from the base part upon physical impact to the handle part by an external force being above a first limit value without causing a detachment of the base part from the outer glass surface.

Advantageously, this provides for sacrificing the handle part, while the base part and the bonded connection between the base part and the outer glass surface is protected. E.g. at a physical impact of an external force being above the first limit value F1, the handle part in an intact or damaged form may be fully or partly dislocated from the base part, while the integrity of the base part and the bonded connection between the base part and the outer glass surface remains intact.

The physical impact providing an external forces being above the first limit value F1 may e.g. be a physical impact provided by a vehicle commonly present in a supermarket, such as a trolley, a floor-cleaning machine or a forklift.

In one or more embodiments, sacrificing the handle part upon impact may be enabled by the structural and/or material properties of the handle assembly. As mentioned previously, the bonding strength of the mounting connection may be arranged to be weaker than the bonded connection between the base part and the glass pane upon impacts e.g. by a trolley.

In one or more embodiments, the handle part may be of a material, which more easily bends, breaks or stretches than the base part. E.g. the handle part may be plastically or elastically deformable in one or more areas of the handle part, such as in areas neighbouring the base part, so that upon impact the handle part is deformed and thereby sacrificed, e.g. dislocated, from the base part. For example, the protrusions may be rigid, while the handle part extending along and above the base part is more weak, brittle or elastic allowing for it to bend, break or stretch and thereby to be sacrificed upon impact, e.g. by hyperextension beyond a breaking point of the material. The opposite scenario is also possible. Additionally, or alternatively, the entire handle part enclosing the base part may stretchable, bendable or breakable upon impact.

In one or more embodiments, the structural assembly of the mounting connection between the base part and the handle part may be arranged to allow transfer of forces during normal operation of the handle assembly by a user and simultaneously be arranged to absorb forces applied to the handle part of the handle assembly during impacts, e.g., by a shopping trolley, so that the absorbed forces provides dislocation or breaking of the handle part, thereby protecting the base part and the glass pane. A structural assembly of the mounting connection allowing such a behavior of the handle assembly may for example be provided by the structural design of the interaction between the recess(es) and protrusion(s) of the handle assembly, e.g., the strength of the mounting connection may depend on the selection of dimensions and geometries involved in the mounting connection, e.g., the depth and/or height of the recess, the length and/or thickness of the protrusion, contact area size, the tightness of the fit, and/or overlap between the recess and protrusion, e.g., the overhang depth, etc.

The adhesion between the glass surface and the base part may preferably be made by an adhesive, preferably an optically clear and transparent adhesive. The adhesive may include one of more of the following adhesives: acrylic glue, Epoxy glue, Epoxy-Resin glue, UV curable glass glue, MS polymer glass glue, co-polymer adhesive, such as Ethylene-Vinyl Acetate (EVA) e.g. EVA-film, cyanoacrylate glue, such as rubber toughened cyanoacrylate glue.

In one or more embodiments, the handle part may be made of a plastic material, such as Polycarbonate or Polymethylmethacrylat (PMMA). This provides the benefits of having a handle part, which is of lower impact strength than other material, such as metal, so as to cause less harm to the impacting object e.g. a human. A plastic handle part also has advantages over glass handle parts, which may shatter upon impact. Plastic material can be readily modified to have the properties needed for the handle part, furthermore it can be made by readily available manufacturing methods. In a preferred embodiment, the handle part is made of Polymethylmethacrylat (PMMA), in particular made by injection moulding. In one or more embodiments, the handle part is a single contiguous element, such that the protrusions are contiguously arranged with the remainder of the handle part.

In one or more embodiments, the mounting connection is not a permanent connection, but the handle part may be connected and disconnected from the base part by e.g. twisting, pivoting or sliding the handling part off the base part. When attached to the base part, the handle part is rigidly attached, so as to be able to provide a transfer of closing and opening force of the user via the handle assembly.

In an event that a shopping trolley rams the handle, it will detach from door/lid without damaging any of the components, such as the base part and/or the handle part itself. Advantageously, according to the present invention, no nails or screws, boreholes, bolts, nuts or the like are needed to mount the handle assembly onto the glass pane, thereby maintaining the integrity and strength of the materials involved.

In one or more embodiments, the handle part may be configured to be mounted to the base part from the side of the base part, from the front of the base part, from below and/or above the base part of from a combination thereof. In one or more embodiments, the handle part is preferably configured to be mounted after the base part has been bonded to the glass pane.

In one or more embodiments, the handle assembly comprises at least one recess, such as at least two recesses or such as at least four recesses. The recesses may be of any shape, such as elongated or point-like recesses. In one or more embodiments, the handle assembly comprises at least one protrusion, such as at least two protrusions or such as at least four protrusions. The protrusions may be of any shape, such as elongated or point-like protrusions, with any shape of a tip of the protrusion such as a rounded or pointed tip.

In one or more embodiments, the base part is made of a plastic material, such as such as Polycarbonate or Polymethylmethacrylat (PMMA). In one or more embodiments, the base part is made of a plastic material suitable for an injection moulding manufacturing process, such that the base part can be produced by injection moulding. Manufacturing parts by injection moulding allows for a fast and cost-effective manufacturing process, with a large degree of flexibility in design and structural strength.

In one or more embodiments, the base part is made of a glass material.

In one or more embodiments, the glass material may be a tempered glass material. In one or more embodiments, the base part is made of a substantially transparent glass material. In one or more embodiments, the base part is made of the same glass material as the glass pane.

Advantageously, this provides the handle assembly provided is of an aesthetic appearance reassembling the glass pane, whereby the glass pane with the handle assembly is more pleasing to the eye. This may in particular provided by the glass-to-glass bond between the base part and the outer glass surface.

By having the base part being made of a glass material, preferably the same glass material as the glass pane, additionally provides for the same or similar coefficients of expansions for the base part and the glass pane. This is especially advantageous, since different coefficients of expansions between two materials bonded together can cause significant stresses in the interface of the two surfaces, which may eventually cause damage to the structural integrity of the surfaces. In the present invention, the base part and the glass pane may both be of glass, having the same coefficient of expansion, and thereby significantly reducing such stresses and risk of damage. This is especially advantageous for refrigerating unit, where the glass pane may generally have a different temperature than the handle. In one or more embodiments, the adhesives used between the bonded surfaces may be sufficiently elastic not to cause any damaging stresses to the bonded surfaces due to temperature differences of the refrigerating unit.

In one or more embodiments, the mounting connection is arranged to prevent transverse movement of the handle part relative to the base part, wherein transverse movement is defined along a first direction being parallel to the outer surface of the glass pane, the mounting connection is further arranged to prevent outward movement of the handle part relative to said base part, wherein outward movement is defined in a direction including a directional component perpendicular to the outer glass surface of the glass pane.

In one or more embodiments, the handle part may be prevented from moving in a first direction along the outer surface of the glass pane, while being moveable in a second direction along the outer surface of the glass pane, e.g. such that the handle part can be dislocated from the base part when applied a force along the second direction and such that the handle part is retained on said base part when a force is applied in the first direction.

In one or more embodiments, the mounting connection is arranged to prevent transverse movement of the handle part relative to the base part in any direction along the outer surface of the glass pane.

Advantageously, this makes the handle assembly more readily applicable for all types of doors, lids etc. as the handle assembly may be operable in any orientation on the outer glass surface. In one or more embodiments, the handle part may be arranged to be slidably mounted onto the base part and a retainer connection may provide so as to add back-stopping effect preventing demounting of the handle part opposite to the direction in which it was mounted. The handle bar may include the retainer connection at an end thereof, or at both ends thereof. Alternatively or additionally, the retainer-connection may be provided by a separate retainer-element of the handle assembly. In one or more embodiments, the retainer connection may provide by a snap joint comprising a flexible piece, arranged to retain the handle part on the base part.

In one or more embodiments, the mounting connection includes one or more dove-tail joint(s).

A dovetail joint is advantageous due to its resistance to being pulled apart and thereby providing a mounting connection of high tensile strength. Furthermore, it also provides resistance to lateral displacement in at least one direction. In one or more embodiments, the dove-tail joint may retain the handle part on the base part in two direction, while allowing the handle part and the base part to be relatively displaceable along a third direction. E.g., the handle assembly may be formed by a movement of the handle part along the recess(es) in a third direction. In one more embodiments, the dovetail joint is realised by one or more recess provided as "tail(s)" of the mounting connection, which are interlocked with one or more protrusions provided as "pin(s)" of the mounting connection. The recess and/or the protrusion may preferably have a substantially trapezoidal shape. Advantageously, a dove-tail mounting connection requires no mechanical fasteners.

In one or more embodiments, the mounting connection is provided by a snap-joint.

Advantageously, a snap-joint or click-joint or also referred to as snap-fit provides an easy and simple assembly of the handle assembly. Furthermore, the connection strength of a snap joint can be modified by modifying the material strength of the joint. the handle part may include one or more areas, e.g., near the protrusion(s), such as near the root of the protrusion, which is elastically deformable so as to allow connecting and also disconnecting the handle part from the base part if sufficient force is applied. In one or more embodiments, the handle assembly comprising a snap joint mounting connection may be installed by either sideways, from above or below or from the front.

In one or more embodiments, the snap joint comprises at least one flexible part, such as a elastically deformable area of the handle part, and is arranged to provide an attachment between the handle part and the base part after pushing the handle part on the base part, thereby deflecting the flexible part of the handle part and allowing the base part and the handle part to interlock once the protrusion(s) has entered and snapped into the recess(es). In one or more embodiments, the snap joint maybe a cantilever snap joint.

The development of a snap-joint for the present invention require more complex and advanced engineering than when using traditional fasteners such as screws, but has the advantage of preventing holes in the base part and the glass door, which can compromise the strength thereof. Of a further advantage, the snap joint may simultaneously provide for sacrificing the handle part upon impact e.g. by a shopping trolley, thereby further protecting the base part and glass door.

In one or more embodiments, the glass door includes one or more elongated recess(es) provided between the outer glass surface and the base part, and wherein the handle part comprises one or more elongated protrusions for insertion in the recess(es).

In one or more embodiments, the elongated recesses or grooves may be arranged in the base part itself or it may preferably be formed between the base part and the glass surface. In one or more embodiments, the elongated recess is preferably provided so that the mounting connection may be formed by a relative sliding movement of the handle part and the base part along the outer glass surface of the pane. Alternatively, the elongated recess may be provided between ends of the base part devoid of a recess, such that the handle part may be snapped onto the base part and retained from moving along the recess, laterally in any direction or outwards when mounted thereon.

In one or more embodiments, the one or more recess(s) is arranged at least at a first rim and at an opposing second rim of the base part.

The rim may be regarded as the edge of the base plate, and the recesses may be regarded as being arranged at the rims, if they are arranged near the rims, such as between the glass pane and the base plate. Advantageously, having two recesses arranged opposite each other allows for a larger and more stable gripping force of the handle part.

In one or more embodiments, the first rim and the second rim are arranged substantially perpendicular to a direction of an opening or closing movement of the glass door, e.g. if the handle assembly is mounted on a vertical sliding door, the first and second rims of the base plate are base plate rims arranged substantially vertically. In one or more embodiments, the first rim may be an upper rim of the base plate, the second rim being a lower rim of the base plate.

In one or more embodiments, the adhesion surface has a bonding area between 10-80 $cm^2$, such as between 20-60 $cm^2$, preferably between 25-45 $cm^2$.

Advantageously, bonding areas within these intervals provides an adhesion surface allowing for particular strong bonds between the glass pane and the base part, sufficiently strong to avoid dislocation of the base part from the glass pane upon impact, e.g. by a shopping trolley. In one or more embodiments, the adhesions surface is defined as the contact surface between the base part and the outer glass surface, preferably a planar contact surface arranged in parallel with the outer glass surface. The bonding area may be enclosed by a rim of the base part.

In one or more embodiments, the adhesion surface of the base part has a longitudinal extent of at least 50 mm, such as of at least 100 mm, preferably at least 150 mm. In one or more embodiments, the adhesion surface of the base part has a longitudinal extent between 50-600 mm, such as between 75-400 mm, such as between 100-300 mm, or such as between 150-200 mm.

In one or more embodiments, the adhesion surface of the base part has a transverse extent of at least 8 mm, such as at least 12 mm, preferably at least 18 mm. In one or more embodiments, the transverse extent is between 10-50 mm, such as between 12-40 mm, preferably between 15-25 mm.

In one or more embodiments, the base part includes a mounting surface arranged opposite to the adhesion surface and having a transverse extent of at least 10 mm, such as at least 15 mm, preferably at least 20 mm. In one or more embodiments, the transverse extent is between 12-55 mm, such as between 15-45 mm, preferably between 20-30 mm.

In one or more embodiments, the longitudinal extent of the base part is substantially parallel to the extent of the outer glass surface. In one or more embodiments, the transverse extent of the base part is parallel to the extent of the outer glass surface.

In one or more embodiments, the base part is of substantially plate like shape e.g. of a thickness smaller than the longitudinal and transverse extents of the base part.

In one or more embodiments, the base part may be of a thickness between 2-20 mm, such as between 3-10 mm, or such as between 5-7 mm. The thickness is measured along a direction perpendicular to the glass pane. Advantageously, the small protrusion of the baseplate from the glass pane provides less risk of dislocation of the base plate upon impact, such as impact from the side.

In one or more embodiments, the adhesion surface is bonded to the outer glass surface by adhesive, such as Ethylene vinyl acetate (EVA) or a light-cured adhesive, such as ultra violet cured adhesive.

By the present invention, a handle is provided without having to drill holes through the glass pane and/or the base part during fastening of the handle. Instead, in the present invention the adhering surface of the handle assembly is simply bonded to the glass surface via the base part, e.g. by means of an adhesive.

In one or more embodiments, the glass pane may be a toughened glass pane, such as a thermally or chemically tempered glass pane. The present invention may in particular be used in vertical door or sliding door/lid of a refrigerating unit. In one or more embodiments, the glass door may be installed as a part of a cover for a refrigerating unit, e.g. as a horizontally arranged sliding lid.

The second aspect of the present invention relates to a refrigerating unit for storing and displaying goods, wherein the refrigerating unit includes a glass door.

The second aspect of the invention may include any combination of the embodiments and features and associated benefits as disclosed in relation to the first aspect of the invention.

BRIEF DESCRIPTION OF THE DRAWINGS

Aspects of the present disclosure will be described in the following with reference to the figures in which.

DETAILED DESCRIPTION OF THE INVENTION

Figure 1:
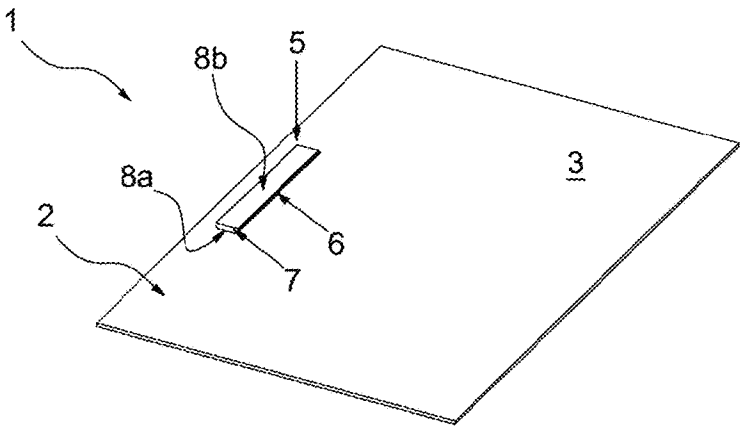
FIG. 1 shows a glass door with a base part adhered thereto according to the invention, as seen in perspective.

FIGS. 1-5 shows examples of the glass door 1 according to embodiments of the invention. In FIG. 1, the handle part 10 has been omitted in order to show the base part 5 bonded to the glass pane 2 on its own. FIGS. 2-5 shows the handle assembly 4 bonded to a glass pane 2 from different views. The glass pane 2 is transparent and may be of any type of glass typically used for glass doors, such as soda lime glass. The glass pane 2 typically has an outer surface to be arranged towards the user, when the glass pane 2 is used in a refrigerating unit and an inner surface arranged towards the goods in the refrigerating unit. The inner and outer surfaces are joined by a glass pane edge, typically much smaller in extent than the width and length of the glass pane 2.

FIG. 1 shows a glass door 1 with a base part 5 of the handle assembly 4 according to embodiments of the invention, as seen in perspective. The base part 5 is of an elongated plate shape, having a mounting surface 8*b* as an uppermost surface substantially planar and substantially parallel to the lowermost surface of the base part 5, wherein the lowermost surface is the adhesion surface 8*a*. Connecting the mounting surface 8*b* and adhesion surface 8*a* of the base part 5 is a rim including two end rims 7 arranged perpendicular to the longitudinal extent of the base part 5 and two side rims 6 arranged along the longitudinal extent of the base part 5.

In one or more embodiments, the base part 5 may have a transverse cross-sectional shape, which allows for a recess to be provided between the glass pane 2 and the base part 5. The base part 5 may include a trapezoid transverse cross-sectional shape, wherein the transverse cross-section has a short side at the adhesion surface 8*b*, a long side at the mounting surface 8*b* and two tapering sides, at the side rims 6 extending from the adhesion surface 8*a* to the mounting surface 8*b*.

In the present examples, the adhesion surface 8*a* is bonded to the glass pane 2 by means of an EVA film. The base part 5 is made of a transparent glass material, preferably the same glass material as the glass pane. In the present examples, the base part 5 provides a transverse extent of the adhesion surface of about 20 mm and a longitudinal extent of the adhesion surface of about 170 mm. The base part 5 may extend approximately 6 mm in thickness measured perpendicular to the outer surface of the glass pane 3. A first and second recess are provided between the tapering side rims 6 and the glass pane 2. In one or more embodiments, the degree of tapering of the side rims 6 may be the same or they may be different. In one or more examples, one or more of the corners of the transverse cross-sectional shape of the base part 5 may be chamfered.

In one or more examples and as shown in FIG. 1-4, the base part 5 provides two elongated recesses 9, each extending adjacent to a side rim 6, from the an end rim 7 to and opposite end rim 7 of the base part 5.

Figure 2:
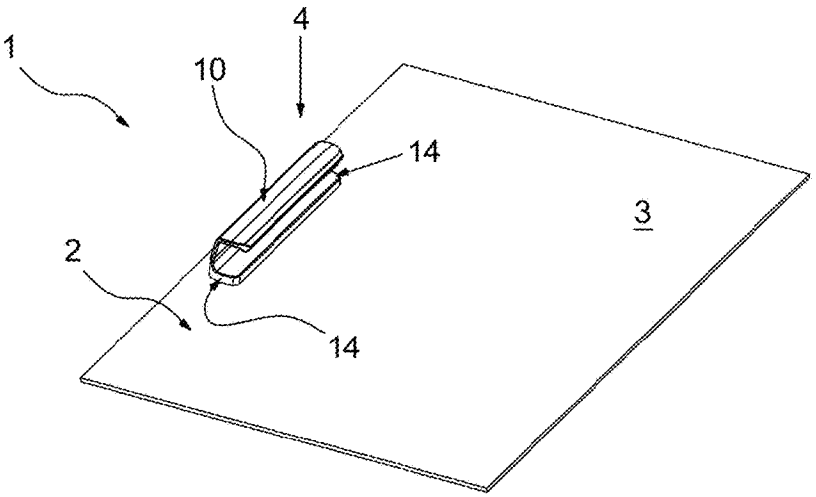
FIG. 2 shows a part of the glass door of FIG. 1 with a handle assembly according to the invention, seen in perspective.

FIG. 2 shows a part of the glass door 1 of FIG. 1 with the addition of a handle part 10, which has been attached to the base part 5 of FIG. 1 so as to form a handle assembly 4 of the glass door 1 according to embodiments of the invention. The handle part 10 is shown arranged to cover at least a part of a mounting surface 8*b* of the base part 5 as shown in FIG. 1. In one or more examples, the handle part 10 may extend at least transversely across the mounting surface 8*b* of the base part 5, from a first recess 9 to a second recess 9 of the base part 5.

The handle part 10 shown in FIGS. 2-5 includes a gripping part for gripping the handle part 10 by a hand of the user. The gripping part is shown at a proximal end extending outwards in a direction away from the outer glass surface 3 and thereafter extending sideways, substantially along said outer glass surface 3, so as to form a substantially L-shaped gripping part. At a distal end of the gripping part, it may curve inwards towards the outer surface of the glass pane.

The gripping part may be of any shape allowing for a sufficiently firm grip of the handle assembly 4 when moving the glass door 1.

In one or more examples shown in FIGS. 2-5, the mounting connection is arranged to prevent at least transverse movement and outward movement of the handle part 10 relative to the base part 5, wherein transverse movement is defined along the transverse extent of the base part 5, i.e. along the short extent of the base part 5 parallel to the outer glass surface 3 and perpendicular to the longitudinal extent of the base part 5, measured along the long extent of the base part 5. The outwards movement is defined in a direction including a directional component perpendicular to the outer glass surface 3 of the glass pane 2.

In one or more examples shown in FIGS. 2-5, the mounting connection is arranged to prevent longitudinal movement of the handle part 10 relative to the base part 5, wherein the longitudinal movement is defined along the longitudinal extent of the base part 5. The longitudinal movement may prevented in one or both directions.

Figure 3:
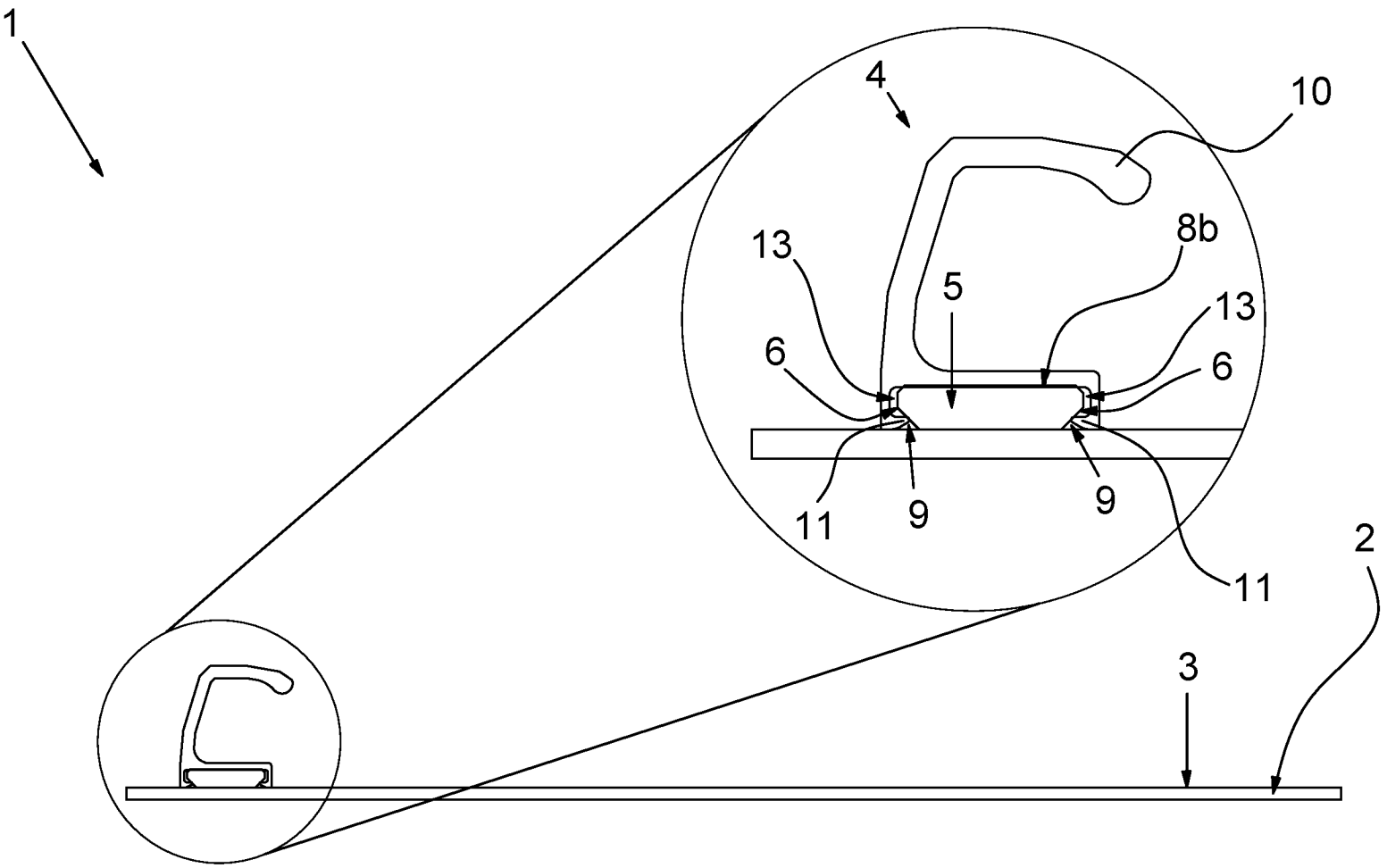
FIG. 3 shows a cross-sectional view and an exploded view of the glass door with a handle assembly according to the invention as shown in FIG. 2.
Figure 4:
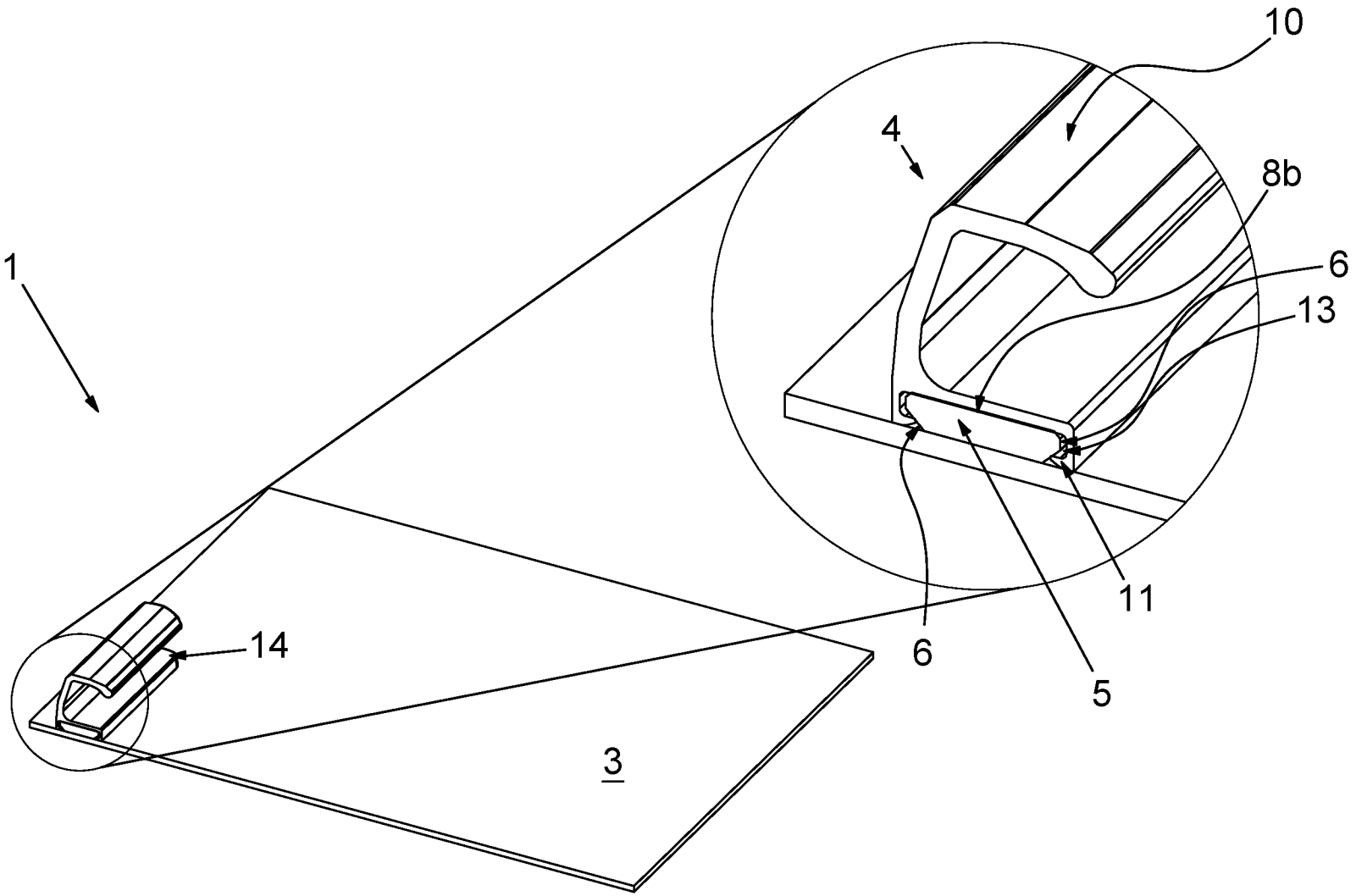
FIG. 4 shows cut-out of the glass door with a handle assembly of FIG. 2, seen in perspective and an exploded view of the cut-out.

In FIGS. 2-4 the longitudinal movement is prevented in both directions, e.g., up and down, or back and forth. The handle assembly 4 is seen including a retainer-connection at both ends of the longitudinal extent of the base part 5 of the handle assembly 4. One or both retainer-connections may be included in the handle part 10, i.e., contiguous with the handle part 10 and/or one or both retainer-connections may be a separate end-piece 14 of the handle assembly 4, which is attached to either the base part 5 or the handle part 10 by suitable connection, such as a snap-joint. The end piece 14 may have a transverse cross-sectional shape similar or the same as the transverse cross-sectional shape of the handle part 10 at the connecting interfaces. In one or more embodiments of the invention, the handle part 10 may be so rigidly attached to said base part 5 by the mounting connection, that no additional retainer-connection is needed.

FIG. 3 shows a transverse cross-sectional view of the handle assembly 4 of FIG. 2. Here it is shown how the handle part 10 extends around from the first recess 9 between the base part 5 and the glass pane 2 at a first side rim 6 over the mounting surface 8*b* and into the second recess 9 arranged opposite the first recess 9. Two protrusions 11 of the handle part are seen extending into the recesses 9 in FIG. 3, such that the protrusions 11 are positioned between the outer surface of the glass pane 3 and the base part 5, here the side rims 6 of the base part 5. Effectively, the handle part 10 is retained in the recesses 9 and is prevented from transverse movement as well as outwards movements of the handle part 10 in a direction perpendicular to the glass pane 2 due to the interaction between the protrusions 11 and the recesses 9.

As shown in FIG. 3 the handle part 10 includes a mounting cavity 13 having an inner surface of the mounting cavity 13 and with a mounting opening provided to the cavity 13. The mounting cavity 13 may be of a substantially curved transverse cross-section, such as a C-shaped, rectangular, circular cross-section or a transverse cross-section of a shape substantially corresponding to the shape of the transverse mounting surface shape of the base part 5. As shown in FIG. 3 the handle part 10 of the present example includes a mounting cavity 13 of a substantially rectangular shape, having an inner surface of the mounting cavity and with a mounting opening provided along one side of the rectangular shape. Two protrusions 11 are additionally seen in FIG. 3, the protrusions 11 are arranged on the handle part 10 so as to decrease the transverse extent of the mounting opening relative to the transverse extent of the mounting cavity 13. The protrusions 11 are in the present example arranged on the inner surface of the mounting cavity 13 and protruding into the mounting cavity 13.

FIG. 4 shows a perspective view of a cutout of the glass door 1 shown in FIGS. 2-3, seen in perspective. The mounting cavity 13 of the handle part 10 is of a size, which can accommodate the base part 5. In one or more examples, the handle part 10 does not provide a through-going cavity large enough to accommodate the base part 5 along the entire longitudinal extent of the handle part 10, but instead the mounting cavity 13 terminates at a distance from an end of the handle part 10. Hereafter, between the terminating point of the mounting cavity 13 and the end of the handle part 10, the handle part 10 provides an end-piece 14 preventing further relative movement of the base part 5 beyond the mounting cavity 13. In one or more examples, the end-piece 14 may be of any shape or form suitable for preventing the base part 5 from protruding beyond the end of the handle part 10. In the present examples, the end-piece 14 is seen extending towards the outer surface of the glass pane 3 and providing a terminating end surface of the mounting cavity 13.

The handle part 10 as shown in FIGS. 2-5 may be mounted on the base part 5 shown on FIG. 1 by sliding mounting cavity 13 of the handle part 10 into engagement with mounting surface 8*b* and/or side rims 6 of the base part 5 in a direction along the longitudinal extent of the handle part 10 and the base part 5. When the handle part 10 has been placed in the right position relative to the base part 5, e.g. such that it covers the base part 5, the handle may be ready to use or it may be further secured to the base part 5 by providing one or more end-pieces 14 covering the end rims 7 of the base part 5 and the end of the handle part 10, e.g. by snap joint connection.

Alternatively or additionally, the handle part 10 may be arranged to be mounted by first inserting a first protrusion 11 into a first recess 9 at a first side rim 6, thereafter pivoting the handle part 10, such that the mounting cavity 13 moves towards the mounting surface 8*b*, applying a force on to said handle part 10 so as to force the second protrusion 11 into engagement with the second recess 9 arranged at an opposite side rim 6 of the first recess 9. Hereafter, the handle assembly 4 may be ready for use. Additionally, the handle assembly 4 may be further secured by one or more end-pieces 14 covering the end rims 7 of the base part 5 and the end of the handle part 10, e.g. by a snap joint connection.

In one or more examples, two end-pieces 14 are provided; a first end-piece contiguously integrated as a part of the handle part 10 at a first end of the handle part 10 and a second end-piece 14 connected to a second end of the handle part 10. The handle part 10 is configured to be installed on the base part 5 by first engaging the second end of the handle part 10 with the base part 5, sliding the handle part 10 along base part 5 until the handle part 10 is in the right position and so that each protrusion 11 come into engagement with a recess 9 of the base part 5. At the second end of the handle part 10, a snap joint connection is provided. The snap joint-connection is configured to be displaced by a biasing force so as to provide an opening large enough to allow the insertion of the base part 5 into the mounting cavity 13 of the handle part 10. E.g. the snap joint connection may be forced in a direction perpendicular to the outer glass surface 3 when the second end of the handle part 10 is pressed onto the base part 5. Upon release of the biasing force the snap joint connection is arranged to restore its equilibrium position. After placement of the handle part 10 in the installed position on the base part 5, at least a part of the snap-joint connection extends beyond the end rim of the base part 7 allowing for the snap-joint connection to at least partially restore its equilibrium position, whereby the snap joint connection is arranged to extends along at least a part of the end rim of the base part 7, thereby effectively reducing the size of the mounting cavity 13 at this position, and preventing a further sliding movement of the handle part 10 relative to the base part 5. At the second end of the handle part 10, the handle part 10 is preferably devoid of any protrusions, thereby allowing space for the snap-joint connection to operate within. In the final installed state of the handle assembly 4, the snap-joint connection may provide an outer surface of the second end of the handle part 10, which is preferably flush with neighbouring outer surfaces of the handle part 10. In one or more examples, both end-pieces 14 may be contiguously integrated as a part of the handle part 10.

Figure 5:
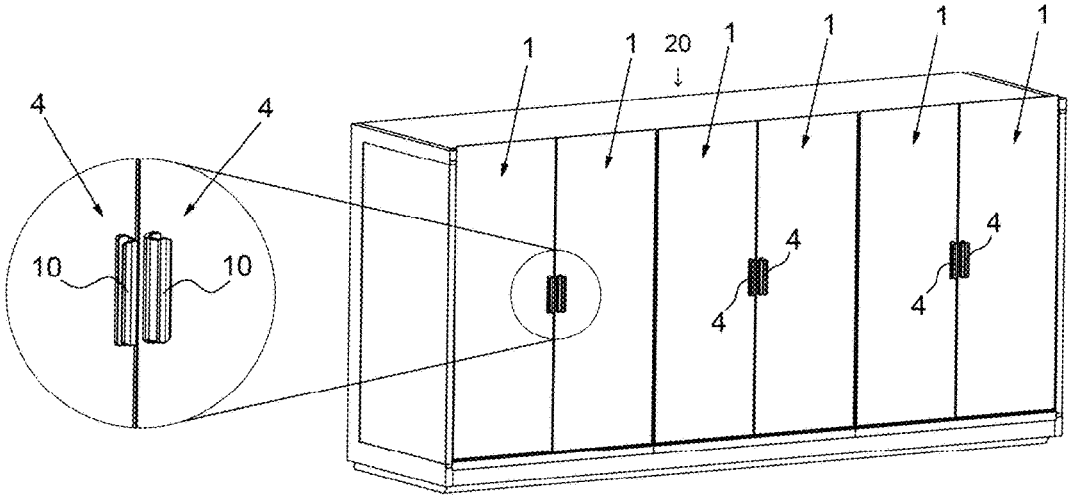
FIG. 5 shows a refrigerating unit comprising a glass door according to the present invention with an exploded view of a part of the refrigerating unit.

FIG. 5 shows a glass door 1 according to examples and/or embodiments of the invention installed as a vertical door of a storage unit 20 of a refrigerating unit. Due to the transparency of the handle assembly 4, the handle of the glass door 1 is less noticeable and more pleasing to the eye compared to an opaque handle. In the present example, the vertical glass door 1 is operated by pulling or pushing the door 1 via the handle part 10, such that the glass door 1 pivots about hinges of the refrigerating unit.

The handle assembly of one or more of the present examples, may be arranged to allow a detachment of the handle part from the base part upon physical impact to the handle part by an external force being above a first limit value without causing a detachment of the base part from the outer glass surface, which function may e.g. be provided by the snap joint connection provided between the base part and the handle part.

Additionally or alternatively, at least one or more areas of the handle part, e.g. along the mounting cavity, such as at the root of the protrusion(s), may be more elastically or plastically deformable or brittle than the base part and in some cases more than the gripping part of the handle part, so as to allow a partial or full dislocation and/or breakage of the handle part from the base part upon impact. Additionally or alternatively, the structural interaction between protrusions and recesses may be designed to allow such sacrifice of the handle part upon impact, e.g. by establishing a suitably sized overhang depth between the protrusion and the recess.

REFERENCES

1 Glass door
2 Glass pane
3 Outer glass surface of the glass pane
4 Handle assembly
5 Base part
6 Side rim of base part
7 End rim of base part
8*a* Adhesion surface
8*b* Mounting surface
9 Recess
10 Handle part
11 Protrusion
12 Gripping part
13 Mounting cavity
14 End-piece

The invention claimed is:

1. A glass door for a refrigerating unit comprising:
a glass pane;
a handle assembly comprising:
a transparent base part made of glass material and bonded at an adhesion surface to an outer glass surface of the glass pane;
a handle part made in a transparent material; and
a mounting connection for mounting the handle part to the transparent base part, wherein the mounting connection is provided by one or more protrusions of the handle part and by one or more recesses in the transparent base part or one or more recesses provided between the transparent base part and the outer glass surface, and
wherein the handle assembly is configured to provide a detachment of the handle part from the transparent base part upon physical impact to the handle part by an external force being above a first limit value without causing a detachment of the transparent base part from the outer glass surface.

2. The glass door according to claim 1, wherein the mounting connection is arranged to prevent transverse movement of the handle part relative to the transparent base part, wherein transverse movement is defined along a first direction being parallel to the outer glass surface of the glass pane,
the mounting connection is further arranged to prevent outward movement of the handle part relative to the transparent base part, wherein outward movement is defined in a direction comprising a directional component perpendicular to the outer glass surface of the glass pane.

3. The glass door according to claim 1, wherein the mounting connection is arranged to prevent transverse movement of the handle part relative to the transparent base part in any direction along the outer glass surface of the glass pane.

4. The glass door according to claim 1, wherein the mounting connection comprises one or more dove-tail joints.

5. The glass door according to claim 1, wherein the mounting connection is provided by a snap-joint.

6. The glass door according to claim 1, wherein the glass door comprises the one or more recesses provided between the outer glass surface and the transparent base part, and wherein the handle part comprises the one or more protrusions for insertion in the one or more recesses provided between the outer glass surface and the transparent base part.

7. The glass door according to claim 1, wherein the one or more recesses of the transparent base part are arranged at least at a first rim and at an opposing second rim of the transparent base part.

8. The glass door according to claim 1, wherein the adhesion surface has a bonding area between 10-80 $cm^2$.

9. Glass door according to claim 1, wherein the adhesion surface is bonded to the outer glass surface by adhesive or a light-cured adhesive.

10. The glass door according to claim 1, wherein the handle part is made of Polymethylmethacrylat (PMMA).

11. The glass door according to claim 1, wherein the adhesion surface is bonded to the outer glass surface by ethylene vinyl acetate (EVA) adhesive or a light-cured adhesive.

12. A refrigerating unit for storing and displaying goods, wherein the refrigerating unit comprises:
a storage unit;
a glass door attached to the storage unit by a hinge, wherein the glass door comprises:
a glass pane;
a handle assembly comprising:

a transparent base part made of glass material and bonded at an adhesion surface to an outer glass surface of the glass pane;

a handle part made in a transparent material; and a mounting connection for mounting the handle part to the transparent base part, wherein the mounting connection is provided by one or more protrusions of the handle part and by one or more recesses in the transparent base part or one or more recesses provided between the transparent base part and the outer glass surface, and wherein the handle assembly is configured to provide a detachment of the handle part from the transparent base part upon physical impact to the handle part by an external force being above a first limit value without causing a detachment of the transparent base part from the outer glass surface.

* * * * *